US007069603B2

(12) United States Patent
Flushing

(10) Patent No.: US 7,069,603 B2
(45) Date of Patent: Jul. 4, 2006

(54) FLOOR SAVER TOILET FLANGE

(75) Inventor: Jay David Flushing, Drayton, SC (US)

(73) Assignee: Flushing Flange, LLC, Drayton, SC (US)

( * ) Notice: Subject to any disclaimer, the term of this patent is extended or adjusted under 35 U.S.C. 154(b) by 203 days.

(21) Appl. No.: 10/874,901

(22) Filed: Jun. 23, 2004

(65) Prior Publication Data

US 2005/0283889 A1 Dec. 29, 2005

(51) Int. Cl.
*E03D 11/14* (2006.01)

(52) U.S. Cl. ..... 4/252.1; 4/251.1

(58) Field of Classification Search ..... 4/251.1, 4/252.1, 252.4–252.6; 285/56–60
See application file for complete search history.

(56) References Cited

U.S. PATENT DOCUMENTS 2,229,814 A * 1/1941 Mikolajczak et al. ..... 4/252.5
2,758,316 A * 8/1956 Schwarz et al. ..... 4/252.4
3,821,820 A * 7/1974 Thompson ..... 4/252.6
3,967,836 A 7/1976 Izzi, Sr.
4,165,545 A * 8/1979 Stoltzfus ..... 4/251.1
4,184,702 A 1/1980 Morris
4,562,602 A 1/1986 Cuschera
4,727,904 A 3/1988 Lease
4,780,915 A 11/1988 Cuschera
4,845,914 A 7/1989 Burd
4,866,763 A 9/1989 Cooper et al.
4,922,948 A 5/1990 Van Dijk
5,185,890 A * 2/1993 Dismore et al. ..... 4/252.5
5,246,255 A 9/1993 Forbes
5,377,361 A 1/1995 Piskula
5,492,372 A 2/1996 Dranberg
5,608,922 A * 3/1997 Lewis ..... 4/251.1
5,660,011 A 8/1997 Bleeker
D388,566 S 12/1997 Reid
5,850,716 A 12/1998 Thompson
5,864,990 A 2/1999 Tu
6,115,852 A 9/2000 Olivas
6,119,282 A 9/2000 Serbin
6,128,947 A 10/2000 Anderson, Sr.
6,272,804 B1 8/2001 Leis
6,381,775 B1 5/2002 Sondrup

* cited by examiner

*Primary Examiner*—Charles E. Phillips
(74) *Attorney, Agent, or Firm*—McNair Law Firm, PA; Cort Flint

(57) ABSTRACT

A toilet leak containment assembly for preventing water leaks from a toilet during flushing onto the support flooring into which the toilet is attached. The leak containment assembly contains a leak collector for installation between the toilet base and the support flooring for preventing the water leaks onto the support flooring during flushing. The leak collector contains an attachment flange for attaching the leak collector to the support flooring, a collector pan for collecting water leaks during flushing, and an outlet pipe in fluid communication with the collector pan for channeling the leaks into the plumbing drain pipe. It also contains a leak seal assembly for installation and sealing between the toilet base and the leak collector. The leak seal assembly contains a flow channel for channeling water flow into the outlet pipe of the leak collector, and a seal for sealing between the toilet base and the leak collector.

18 Claims, 6 Drawing Sheets

30
32a
34
32

40
40a 40b
40a
40c
40d 16
19
20
20b
20a 20b
20
20a
19
22

FLOOR SAVER TOILET FLANGE

BACKGROUND OF THE INVENTION

One of the most common and more frustrating home repairs that needs to be made is the replacing of a rotted floor underneath a toilet caused by leakage over time. With the existing toilets and pipes, it is a foregone conclusion that, over time, some leakage will occur when a toilet flushes. The amount of water that does not go directly into the pipe should be forced down into the pipe over time and not be allowed to make contact with the floor or sub-floor where it can rot the floor and cause substantial damage.

Traditionally, a toilet flange is placed in the sub-floor that receives the toilet bowl itself and the plumbing pipe and connects the two. These traditional flanges have four large areas for the placement of screws connecting the toilet to the toilet flange and four additional screws for mounting the flange to the sub-floor. The holes that are used for the screws that connect the toilet to the flange allow for much exposed sub-floor upon proper installation of the toilet. The solution for filling these holes so that no water reaches the sub-floor was the creation of a wax seal. The wax seal consists of a plastic insert that connects the toilet with the toilet flange enclosed in a wax seal. Under the pressure of the toilet upon placing the wax seal in between the toilet and the flange, the wax seal is pressed downward and fills in any holes on the toilet flange and surrounds the base of the toilet. The wax seal provides three benefits, first it protects leakage from reaching the sub-floor by filling the holes, and second it does not allow any gas to escape, and, through it directs water flow to the main drain pipe.

While this system works initially, over time it begins to fail and allows water to reach the sub-floor. As the years and seasons progress, the alternating hot and cold weather expands and contracts the wax seal, thus leaving gaps in the holes the seal had once filled on the toilet flange. By leaving these areas exposed, the water from any leakage may now seep into these holes and begin to damage the sub-floor.

Therefore, it is an object of the present invention to provide a floor flange that protects the sub-floor and floor from water seepage.

It is a further object of the invention to provide a seal assembly for use in combination with the flange that will further protect from any water seepage and use the seal primarily as a blocker of gas and not a protector from water damage.

SUMMARY OF THE INVENTION

The above objectives are accomplished according to the present invention by providing a toilet leak containment assembly for preventing water leaks from a toilet during flushing onto the support flooring into which the toilet is attached. The toilet includes a toilet base having an interior toilet passage through which water flows and to a plumbing drain pipe during flushing. The toilet leak containment assembly contains a leak collector for installation between the toilet base and the support flooring for preventing the water leaks onto the support flooring during flushing. The leak collector contains an attachment flange for attaching the leak collector to the support flooring, a collector pan for collecting water leaks during flushing, and an outlet pipe in fluid communication with the collector pan for channeling the leaks into the plumbing drain pipe. The toilet leak containment assembly also contains a leak seal assembly for installation and sealing between the toilet base and the leak collector. The leak seal assembly contains a flow channel for channeling water flow into the outlet pipe of the leak collector, and a seal surrounding the flow channel for sealing between the toilet base and the leak collector, and also between the flow channel and the interior toilet passage.

The attachment flange contains flange openings for attaching the leak collector to support flooring with attaching screws. The collector pan contains mounting means for allowing the toilet to be mounted to the leak collector. The flow channel of the leak seal assembly may also include an annular flange surrounding the flow channel over lying at least a portion of the seal that surrounds the annular flow channel. The annular flow flange includes an annular flat surface extending to an inclined annular surface for directing water leaks into a plumbing drain pipe.

DESCRIPTION OF A PREFERRED EMBODIMENT

Referring now in more detail to the drawings, the invention will now be described in more detail.

Figure 1:
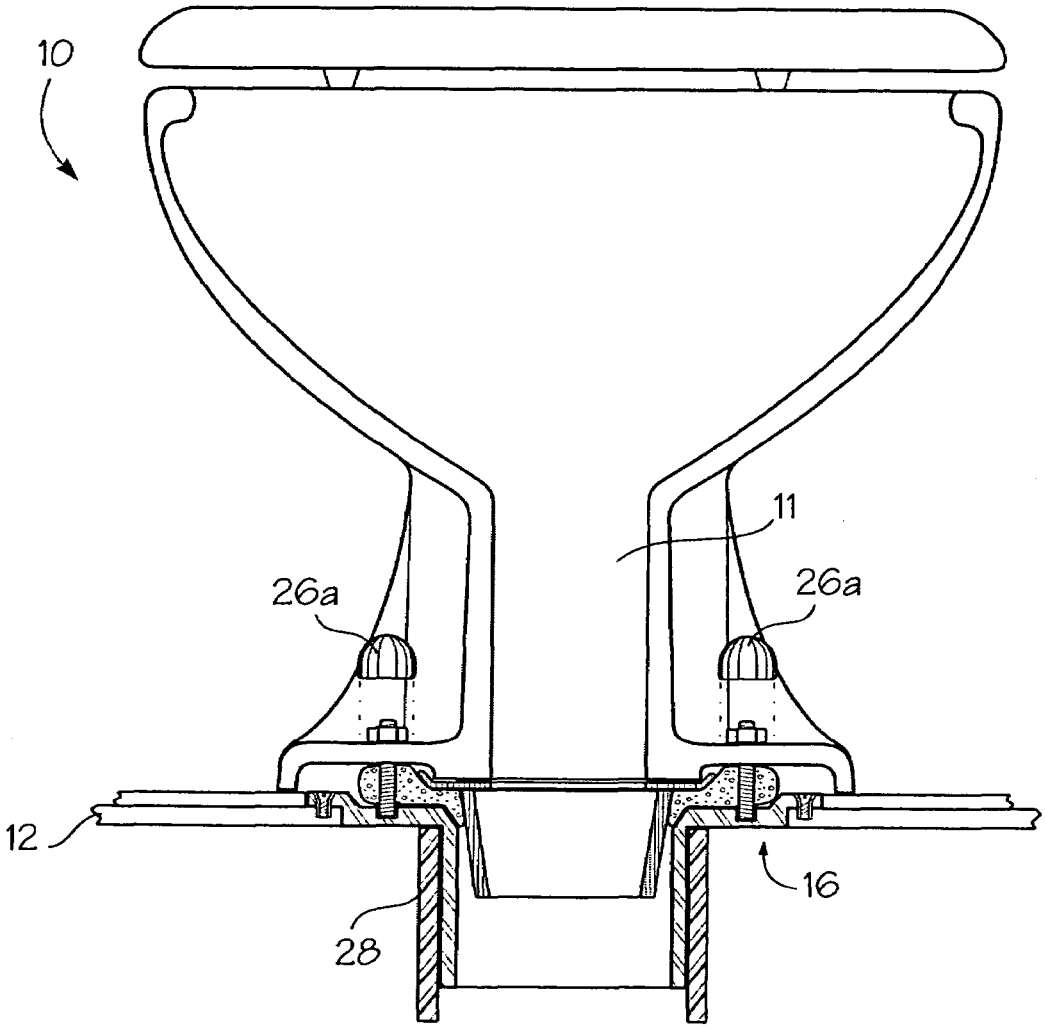
FIG. 1 is a rear view of a toilet mounted on the floor with the leak seal assembly and leak collector.

Referring now to FIG. 1, the invention is shown as having been installed into its environment. As can be seen, toilet 10 rests on sub-floor 12. Attached to sub-floor 12 is leak collector 16. Leak collector 16 is made up of an attachment flange 19, a collector pan 20 and an outlet pipe 22, as shown in FIGS. 5A and 5B.

Figure 2:
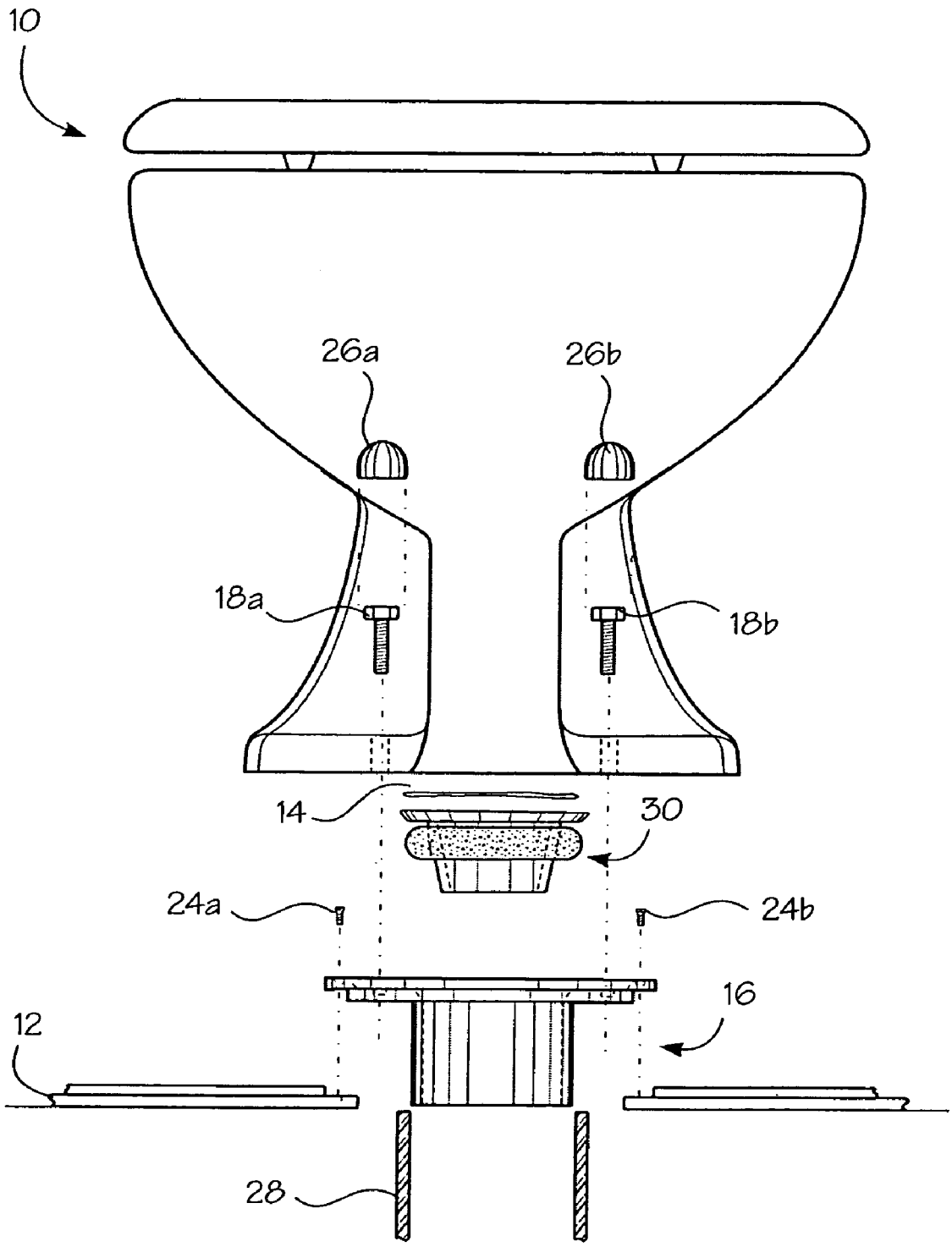
FIG. 2 is an exploded view of FIG. 1.
Figure 3:
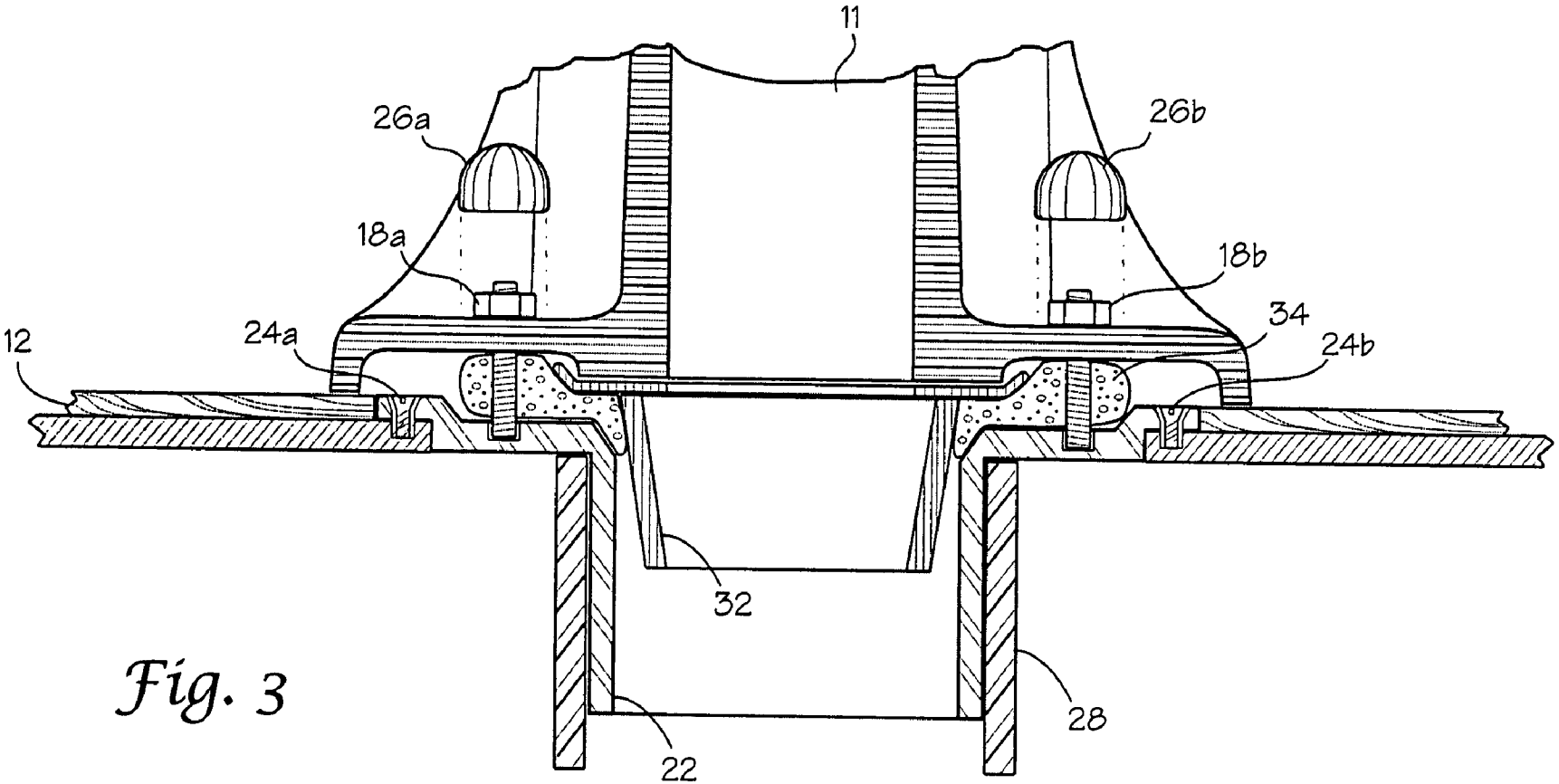
FIG. 3 is a rear view of a toilet mounted on the floor with the leak seal assembly and leak collector.
Figures 4, 5A, 5B, 6A, 6B:
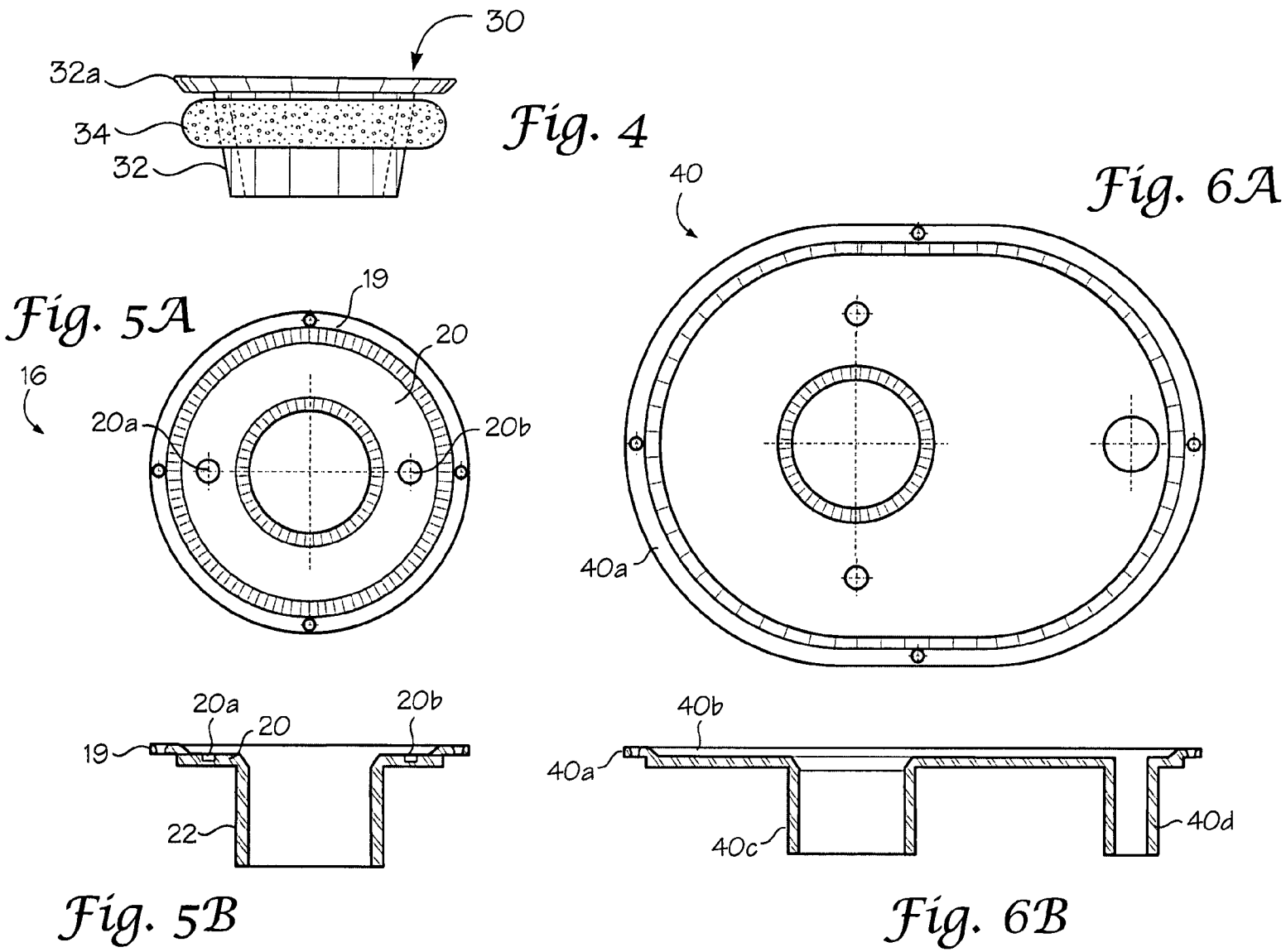
FIG. 4 is a side view of the leak seal assembly.
FIG. 5*a* is a top view of the leak collector.
FIG. 5*b* is a side view of the leak collector.
FIG. 6*a* is a top view of a leak collector with a second outlet pipe.
FIG. 6*b* is a side view of a leak collector with a second outlet pipe.

Leak collector 16 is shown in more detail in FIGS. 5*a* and 5*b*. As can be seen, attachment flange 19 contains four attachment openings to allow attachment of the leak collector to the sub-floor. Collector pan 20 serves two purposes. First, it collects any water leaks and channels them to outlet pipe 22. Second, there are two mounting elements 20*a* and 20*b* provided in collector pan 20 for mounting a toilet to the collector pan. Note that in FIG. 5*b*, the mounting elements are mounting openings that do not extend into the support flooring of the house. Rather they open into the leak collector and there is an area collector pan 20 protecting the sub-flooring from being exposed through the mounting openings. Note that in a preferred embodiment self mounting screws can be used to mount a toilet to the collector pan. The fact that the openings do not extend into the support flooring provide an additional protection from any exposure of the support flooring to any potential water leaks that are collected in the collector pan. As any water leaks in the collector pan cannot flow to the support flooring through the mounting openings 20*a* and 20*b*, the leaks will naturally flow into outlet pipe 22 which connects to the existing plumbing drain pipe. Attachment screws 24*a* and 24*b*, as shown in FIG. 2, are used to attach leak collector 16 to sub-floor 12. Leak collector 16 sits on sub-floor 12 and the outlet pipe fits into the existing plumbing of the house 28. Note that as shown the existing piping fits around leak collector 16's outlet pipe, however, the leak collector outlet pipe can also receive more narrow pipes within the outlet pipe. Toilet 10 is mounted onto leak collector 16 with mounting screws 18*a* and 18*b*, as shown in FIG. 3. The tops of those screws will then be covered by screw caps 26*a* and 26*b*. Note that the mounting screws 18*a* and 18*b* do not reach the sub-floor 12, rather they are received by leak collector 16 in a manner that only requires the mounting screw to make contact with the leak collector, and not the sub-floor.

As can best be seen in FIG. 2, prior to mounting toilet 10 to leak collector 16, leak seal assembly 30 is attached to toilet 10 via glue 14. Note that in this preferred embodiment a high strength, water proof glue is used to connect leak seal assembly 30 to toilet 10. However, in alternative embodiments other appropriate attachment means including, but not limited to, screws could be used to attach leak seal assembly 30 to toilet 10. Once attached, the leak seal assembly is received by the leak collector 16. As can best be seen in FIG. 4, the leak seal assembly 30 has an annular flow channel 32, and a seal 34 that surrounds the circumference of the annular flow channel. The annular flow channel 32 is surrounded by annular flange 32*a*. Annular flange 32*a* over lies at least a portion of seal 34. The annular flange 32*a* includes an annular flat surface extending to an inclined annular surface for directing water leaks into the annular flow channel for channeling the water flow into the leak collector and thus into the associated plumbing drain pipe. The annular flow channel is received by leak collector 16. Note that in the preferred embodiment a wax seal is used and as is shown in FIG. 1, the wax is displaced over the leak collector by the weight of toilet 10.

Referring now to FIG. 2, an exploded view of FIG. 1 is shown. Toilet 10 is attached to leak seal assembly 30 via glue 14. Leak seal assembly 30 is made up of annular flow channel 32 and seal 34, as shown in FIG. 4. Once leak seal assembly 30 is attached to toilet 10, the entire assembly is mounted to leak collector 16 via mounting screws 18*a* and 18*b*. Mounting screws 18*a* and 18*b* are covered by covers 26*a* and 26*b*. Prior to mounting toilet 10 to leak collector 16, it is attached to sub-floor 12 via attaching screws 24*a* and 24*b*. Further, leak collector 16 fits within existing drain pipe 28.

The operation of the invention can best be understood from FIGS. 3, 4, 5A and 5B. Should any leaks from toilet 10 begin to occur, they will initially be contained by leak seal assembly 30, in particular by leak assembly annular flange 32*a* which will direct any leaks downward into annular flow channel 32, which will flow water into outlet pipe 22 of the leak collector, which in turn flows into the existing plumbing drain pipe of the house 28. Should water leak over leak assembly annular flange 32*a* and over compressed wax seal 34, it will accumulate in collector pan 20. As temperatures change and the wax seal 34 expands and contracts it will leave gaps for water to flow over from attachment flange 19 to collector pan 20 and on to outlet pipe 22. Note that as water flows over mounting holes 20*a* and 20*b*, the water in the form of a leak cannot reach the support flooring as the mounting holes do not protrude through the entire collector pan into the support flooring. As such, all water leaks will flow away from the support flooring into an outlet pipe and into the associated plumbing drain pipe of a house and thus avoid any leakage and eventual rotting of support flooring.

Referring now to FIG. 4, the flow containment assembly is shown in more detail. As can be seen from FIG. 4 the seal 34 is preferably made of wax. The wax forms around the perimeter of the containment flange and once attached to the toilet the seal 34 is compressed and forms a barrier as shown in FIG. 1 and in FIG. 3.

Referring now to FIGS. 6*a* and 6*b*, an alternative embodiment of the invention is shown. Note that the same basic structure as desired above in FIGS. 5*a* and 5*b* remains with the same attachment flange 40*a* similar to attachment flange 18 and collector pan 40*b* and primary outlet pipe 40*c*. However, leak collector tray 40 shown in FIGS. 6*a* and 6*b* contains a larger collector pan for collecting leaks, and contains a second outlet pipe 40*d*. This embodiment of the invention is more useful in new residential environments and commercial environments wherein the toilets are flushed multiple times. While the leak collector described above is capable of containing leaks in home toilets, it does not provide the additional benefit that the wider tray and additional outlet pipe 40*d* provide in a commercial environment that has toilets that are flushed multiple times an hour.

Figure 7:
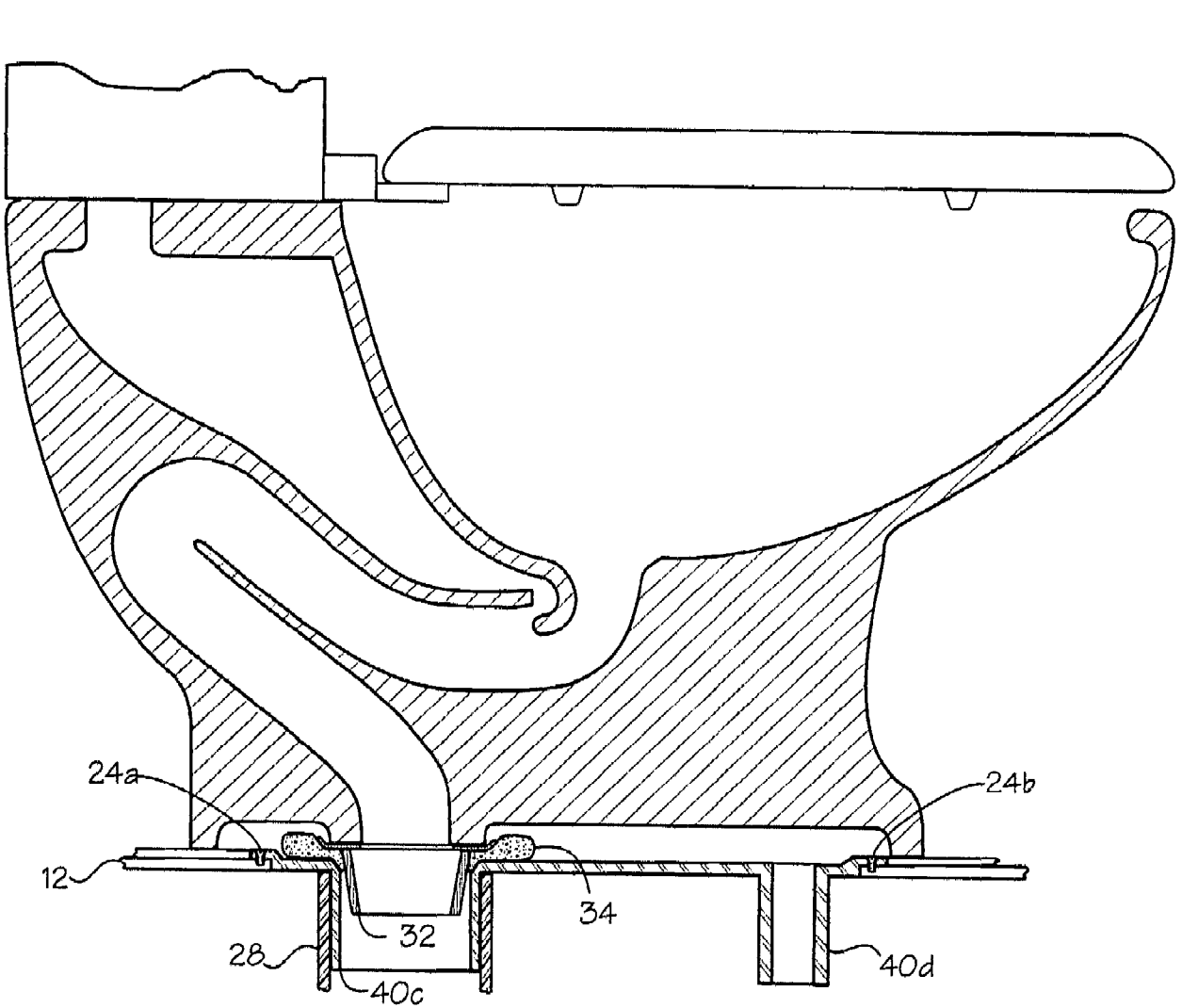
FIG. 7 is a side view of the toilet mounted on the floor with the leak a seal assembly and the leak collector with a second outlet pipe.
Figure 8:
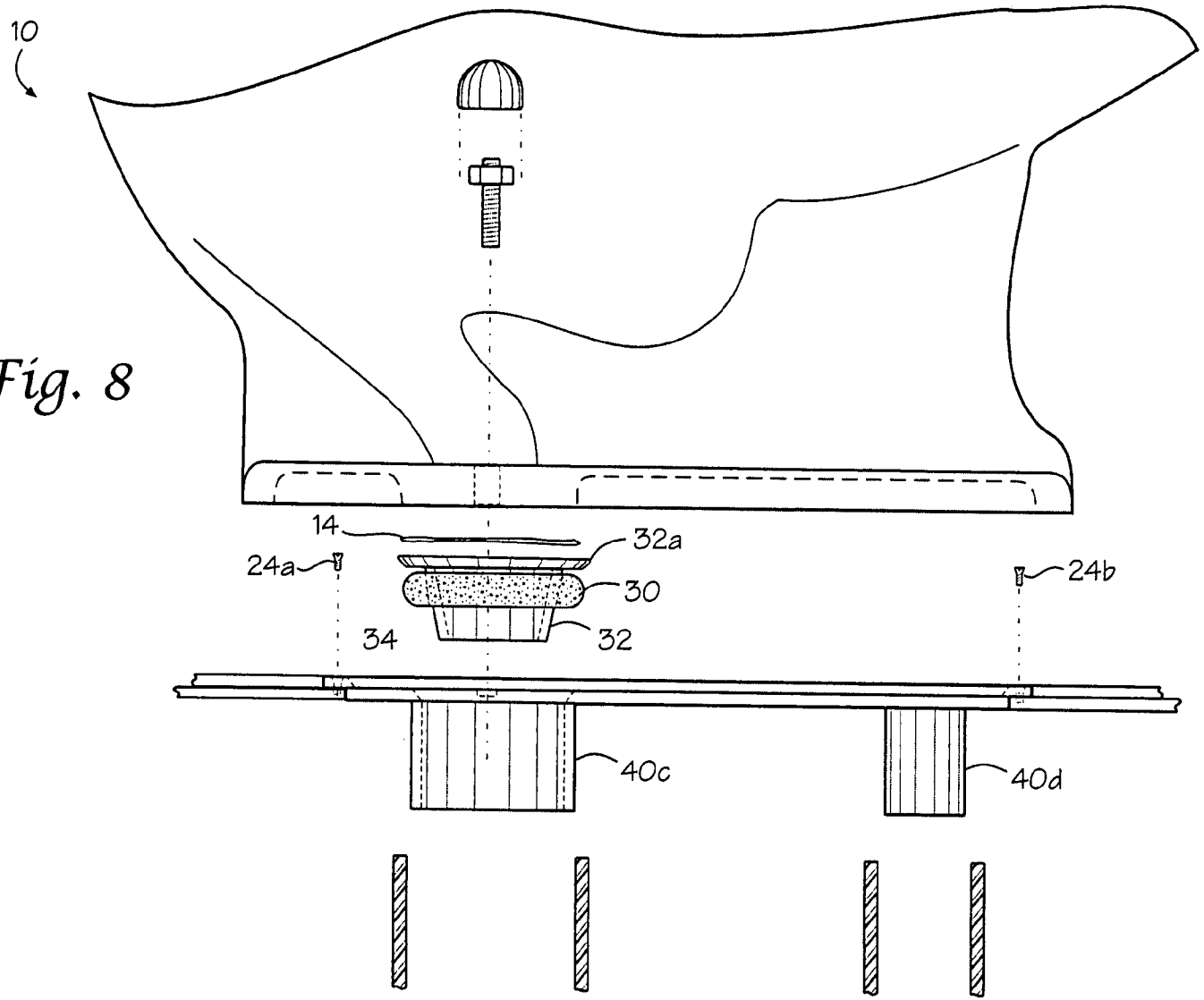
FIG. 8 is an exploded view of FIG. 7.

Referring now to FIG. 7, leak collector tray 40 is shown as having been installed under a toilet. Note that leak seal assembly 30 can still be used over the primary outlet pipe 40*c*. However, under circumstances where a substantial leak occurs and water accumulates beneath the toilet rapidly, the second outlet pipe 40*d* serves to funnel water to a separate reservoir. Note that if water begins moving past primary outlet pipe 40*c*, it will move towards secondary outlet pipe 40*d*. Should a large amount of water fill the entire space and push past outlet pipe 40*d*, then the collector pan is designed in such a way that any water reaching the mounting flange will naturally flow downward into secondary outlet pipe 40*d* and be transported away from support flooring 22 thus avoiding any potential leaks. Note that the area in the sub-floor is much wider for the leak collector tray than for the original leak collector 16. As such, it is more adapted for use in new home construction and commercial settings, where it is most useful due to the large amount of toilet usage in those commercial settings.

While a preferred embodiment of the invention has been described using specific terms, such description is for illustrative purposes only, and it is to be understood that changes and variations may be made without departing from the spirit or scope of the following claims.

What is claimed is:

1. A toilet leak containment assembly for preventing water leaks from a toilet during flushing on to the support flooring to which the toilet is attached, the toilet including a toilet base having an interior toilet passage through which water flows into a plumbing drain pipe during flushing; said assembly comprising:

a leak collector for installation between the toilet base and the support flooring for preventing the water leaks into the support flooring during flushing;

an attachment flange for attaching said leak collector to the support flooring;

a collector pan included in said leak collector for collecting the water leaks during toilet flushing;

an outlet pipe in fluid communication with said collector pan for channeling the leaks into the plumbing drain pipe;

a leak seal assembly for installation and sealing between the toilet base and said leak collector;

a flow channel included in said leak seal assembly for channeling water flow into said outlet pipe of said leak collector; and a seal surrounding said flow channel for sealing between the toilet base and said leak collector.

2. The assembly of claim 1 wherein said attachment flange contains flange openings for attaching said leak collector to the support flooring.

3. The assembly of claim 1 wherein said collector pan contains mounting elements for mounting the toilet to said leak collector.

4. The assembly of claim 3 wherein said mounting elements are located on the floor of said collector pan.

5. The assembly of claim 3 wherein said mounting elements are openings that do not extend through the floor of the collector pan;

whereby any water leakage that enters the openings cannot leak into the support flooring.

6. The assembly of claim 1 wherein said seal surrounding said annular flow channel is a wax seal.

7. The assembly of claim 1 wherein said flow channel included in said leak seal assembly includes an annular flange surrounding said flow channel.

8. The assembly of claim 7 wherein said annular flange overlies at least a portion of said seal surrounding said annular flow channel.

9. The assembly of claim 7 wherein said flow channel is tapered away from said outlet pipe to provide a space for leakage to flow should leakage flow over said annular flange and said seal has deteriorated to allow for water flow into the collector pan and into the outlet pipe.

10. A leak seal assembly for preventing water leaks from a toilet during flushing on to the support flooring to which the toilet is attached, the toilet including a toilet base mounted to the support flooring having an interior toilet passage through which water flows into a plumbing drain pipe during flushing; said assembly comprising:

an annular flow channel for location between the toilet base and the drain pipe to channel water flow into the plumbing drain pipe;

an annular flange surrounding said flow channel, said annular flange includes an annular flat surface extending to an inclined annular surface for directing water into said flow channel, whereby, water leaks are directed into the annular flow channel for channeling water flow into the plumbing drain pipe;

a seal surrounding said annular flow channel for sealing between the toilet base and the plumbing drain pipe; and said annular flange overlying at least a portion of said seal.

11. The assembly of claim 10 wherein said seal surrounding said annular flow channel is a wax seal.

12. The assembly of claim 10 wherein said flow channel is tapered away from the drain pipe to provide a space for leakage to flow should the leakage flow over said inclined annular surface.

13. A leak collector for installation between a toilet base and sub flooring for preventing water leaks from a toilet to contact the sub flooring to which the toilet is attached, the toilet including a toilet base having an interior toilet passage through which water flows into a plumbing drain pipe during flushing; and a seal disposed between the toilet and said collector, said leak collector comprising:

an attachment flange having means for attaching said leak collector to the sub flooring;

a collector pan included in said leak collector, disposed below said attachment flange, having a collection surface above a bottom surface of said sub flooring, for collecting the leaks during toilet flushing, wherein the seal is disposed between the toilet base and collector pan when installed, and an outlet pipe connected to said collector pan for delivering said water leaks collected in said collection pan into the plumbing drain pipe.

14. The leak collector of claim 13 wherein said attachment flange contains flange openings for attaching said leak collector to the sub flooring.

15. The leak collector of claim 13 wherein said collector pan contains mounting elements for mounting the toilet to said leak collector.

16. The leak collector of claim 13 further comprising a second outlet pipe horizontally spaced from said first outlet pipe connected to said collector pan for delivering said water leaks collected in said collector pan into the plumbing drain pipe.

17. The leak collector of claim 13 wherein mounting elements are located on the floor of said collector pan.

18. The leak collector of claim 17 wherein said mounting elements are openings that do not extend through the floor of the collector pan;

whereby any water leakage that enters the openings cannot leak into the support flooring.

* * * * *